US006491272B1

(12) United States Patent
Franks

(10) Patent No.: US 6,491,272 B1
(45) Date of Patent: Dec. 10, 2002

(54) STEP ASSEMBLY WITH A REMOVABLE STEP FOR HOLLOW POLES AND THE LIKE

(75) Inventor: George J. Franks, Inverness, IL (US)

(73) Assignee: Senior Industries, Inc., Wood Dale, IL (US)

( * ) Notice: Subject to any disclaimer, the term of this patent is extended or adjusted under 35 U.S.C. 154(b) by 0 days.

(21) Appl. No.: 09/925,855

(22) Filed: Aug. 9, 2001

Related U.S. Application Data

(63) Continuation-in-part of application No. 09/757,296, filed on Jan. 9, 2001, now Pat. No. 6,378,822.

(51) Int. Cl.[7] ..... E06C 1/34

(52) U.S. Cl. ..... 248/218.4; 248/544; 248/231.9; 248/507; 182/92

(58) Field of Search ..... 248/544, 218.4, 248/222.51, 231.9, 231.91, 500, 507, 503, 505, 508; 182/92, 90; 411/340, 345, 346

(56) References Cited

U.S. PATENT DOCUMENTS 1,322,869 A * 11/1919 Benedict ..... 182/92
1,588,566 A * 6/1926 Wismer ..... 144/307
1,740,873 A * 12/1929 Peirce, Jr. ..... 182/189
5,279,388 A * 1/1994 Laughlin et al. ..... 182/90
5,761,875 A 6/1998 Oliphant et al. ..... 52/721.2
5,941,485 A 8/1999 Davidson et al. ..... 248/218.4

* cited by examiner

*Primary Examiner*—Ramon O. Ramirez
*Assistant Examiner*—Ingrid Weinhold
(74) *Attorney, Agent, or Firm*—Fitch, Even, Tabin & Flannery

(57) ABSTRACT

There is provided a pole step assembly with a removable step for hollow poles and the like. The step assembly includes a mounting subassembly with a mounting stud and a mounting plate with inter-engaging flat surfaces that limit relative rotational movement of the mounting stud and mounting plate about the axis of the subassembly. A clamp is provided to limit radial movement of the subassembly relative to the pole. The mounting stud of the subassembly also may include a handle portion that captivates the components of the subassembly and facilitates ease of installation of the subassembly. The handle also may break away and be removed after installation of the subassembly. The step is mounted to the subassembly and may include flat surfaces that inter-engage with further flat surfaces on the mounting plate to limit rotation of the step about its longitudinal axis.

16 Claims, 3 Drawing Sheets

STEP ASSEMBLY WITH A REMOVABLE STEP FOR HOLLOW POLES AND THE LIKE

CROSS-REFERENCE TO RELATED APPLICATION

This application is a continuation-in-part of U.S. patent application Ser. No. 09/757,296, filed on Jan. 9, 2001 now Pat. No. 6,378,822 B1 and entitled "STEP ASSEMBLY FOR HOLLOW POLES AND THE LIKE".

FIELD OF THE INVENTION

The present invention relates generally to steps for climbing hollow poles, such as utility poles, and similar structures and, more particularly, to a pole step assembly with a mounting subassembly that can be attached to such structures and a removable step that can be readily attached and detached from the mounting subassembly.

BACKGROUND OF THE INVENTION

Elongated poles are commonly used to maintain items above and over the ground for numerous reasons, including safety and ground space conservation purposes. The utility industry, for example, uses many poles to support cables and other components of the utility's system. These poles are often hollow and made of steel and/or fiberglass. These poles are typically fitted with steps that extend radially from the pole in a cantilever fashion to enable utility personnel to climb the pole to perform maintenance operations on the equipment. The specific structures of these pole steps vary.

In a number of instances, there is also a desire for an effective but easily removable step. This is especially the case for the lower portion of poles to prevent unauthorized climbing of the poles. There exists pole step assemblies with detachable steps. A known shortcoming with these assemblies is the lack of adequate protection against unwanted rotation of the step about its longitudinal axis created by a user's foot rubbing across the step or hitting the step from underneath.

The related application, Ser. No. 09/757,296, U.S. Pat. No. 6,378,822 B1 provides a pole step assembly that secures the step against unintentional rotational movement and facilitates efficient and effective installation to the pole by preventing the loss of necessary components. Although this pole step assembly is considered removable, there, however, is a need for additional features to further facilitate removability of the step.

Thus, there remains a need for a pole step assembly that secures the step against unintentional rotational movement and that facilitates efficient and effective installation to the pole by preventing the loss of necessary components. Furthermore, it would be advantageous if the assembly included a mounting subassembly and a removable step so that the step could be easily attached and detached from the pole while the mounting subassembly remained permanently affixed thereto.

SUMMARY OF THE INVENTION

The present invention pertains to a removable pole step assembly that includes a mounting subassembly and a removable step that can be readily attached and detached thereto. A step assembly in accordance with the present invention is capable of selectively securing a removable step to a hollow pole with a mounting aperture.

The assembly includes a mounting stud with a first portion and a second portion. The first portion is capable of engaging the hollow pole to support the mounting stud.

The second portion has an exterior flat portion that is capable of extending through the aperture in the hollow pole to position the first portion inside the hollow pole. A mounting plate is on the stud and has an interior surface with a flat portion to engage the exterior flat portion of the second portion of the mounting stud to limit relative movement between the mounting plate and the mounting stud. The mounting plate also has a major exterior surface and a minor exterior surface. The major exterior surface is stepped from the minor exterior surface such that the major exterior surface is capable of engaging the hollow pole and a gap forms between the minor surface and the hollow pole when the major surface engages the hollow pole. The major surface has at least a portion profiled so when it is engaged with the hollow pole it limits movement between the hollow pole and the mounting plate.

A clamp is on the mounting stud and is capable of selectively engaging the second portion of the mounting stud to secure the mounting plate and the first portion of the stud into engagement with the hollow pole to limit relative movement of the mounting plate and mounting stud with respect to the hollow pole. A removable step has a mounting portion and a foot support portion. The mounting portion defines a slot and is capable of a being received in the gap to engage at least a portion of the minor surface and surround at least a portion of the major surface to limit movement of the step relative to the hollow pole when the mounting plate is in engagement with the pole.

The mounting stud may further include a handle to facilitate installation of the mounting stud and mounting plate. The handle may also be removably attached to the mounting stud. Additionally, the handle may have an enlarged end portion to maintain the mounting plate and clamp on the mounting stud.

Further, the second portion of the mounting stud may define a recess and the handle may have a mounting end that is press fit into the recess to attach the handle. Even further, the handle may have a weaker portion that is capable of being severed to remove the handle when desired, and the enlarged end portion may be C-shaped.

The first portion and the second portion of the mounting stud may be disposed at a predetermined angle relative to one another. The predetermined angle may be generally 90 degrees so that the second portion is capable of extending in a direction that is generally parallel to the radius of the hollow pole.

The major surface of the mounting plate may have an arcuate profiled portion so when it is engaged with the hollow pole it limits movement between the hollow pole and the mounting plate.

The second portion of the pole step stud may have an externally threaded portion. The clamp may include a nut that meshes with the externally threaded portion of the second portion of the mounting stud. The clamp may further include a lock washer interposed between the nut and the mounting plate.

The mounting stud may be sized large enough to prevent the mounting plate and clamp from falling off the mounting stud at the first portion. The exterior flat portion of the second portion of the mounting stud may include at least two flats and the flat portion of the interior surface of the mounting plate may include at least two flats. The flats of the second portion and the interior surface then are capable of engaging each other to limit relative movement between the mounting plate and the mounting stud.

There is also provided a method of attaching a removable pole step assembly to a hollow pole. The method includes the step of providing a removable pole step assembly having a mounting subassembly with a removable handle. The mounting subassembly is attached to the hollow pole, and after such attachment the removable handle is detached. The final step is to attach a removable step to the mounting subassembly.

DESCRIPTION OF THE PREFERRED EMBODIMENT

Figure 1:
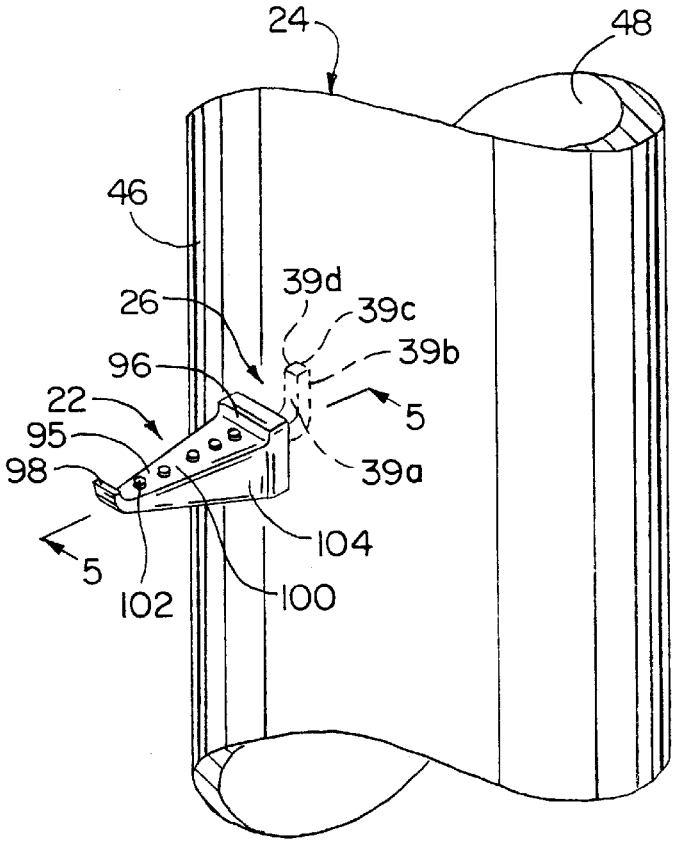
FIG. 1 is a perspective view of an installed pole step assembly with a removable step in accordance with the present invention.
Figure 2:
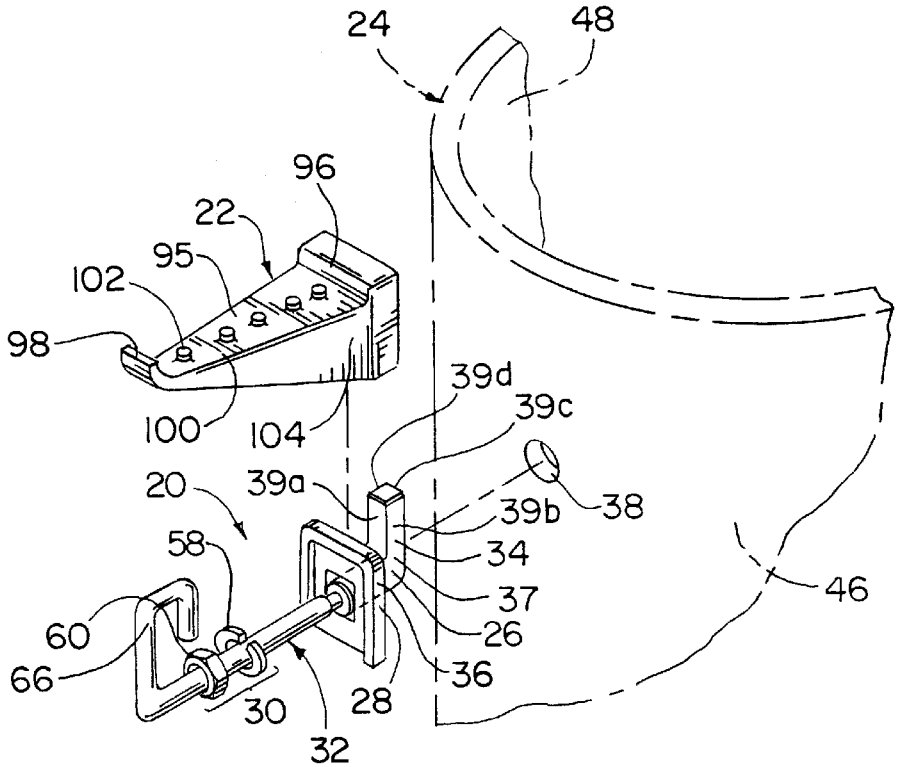
FIG. 2 is an exploded, perspective view of the pole step assembly of FIG. 1 before installation.

Referring to FIGS. 1 and 2, the present invention is embodied in a pole step assembly that includes a mounting subassembly 20 for a removable step 22 that can be readily attached and detached to a hollow pole 24. The mounting subassembly 20 includes a number of inter-engaging surfaces designed to prevent unintentional movement of the step assembly relative to the pole, such as that design also disclosed in the related patent U.S. Pat. No. 6,378,822 B1 which is incorporated by reference herein.

The mounting subassembly 20 includes a pole step stud 26, a mounting plate 28, a clamp 30 and a break away handle 32. The pole step stud 26 and break away handle 32 are shaped and sized to captivate the components of the mounting assembly, such as the mounting plate 28 and components of the clamp 30, into a single assembly, thereby rendering it easier for the user to install the subassembly 20, because there is no additional concerns from potentially dropping or losing necessary components. Once the mounting subassembly 20 has been installed, it is designed to remain in position at the pole 24 while the removable step 22 can be readily attached to (as well as detached from) the mounting subassembly 20 after the break away handle 32 has been removed after installation.

Referring to FIGS. 2–5, the pole step stud 26 includes a first portion 34 and a second portion 36 disposed at an angle to the first portion 34. The first and second portions 34 and 36 are separated by a bend portion 37. For example, the preferred angle of the bend sets the first and second portions 34 and 36 at an angle of about 90 degrees. The preferred radius of curvature for the bend may be 0.133±0.010 inches.

The first portion 34 is designed to engage the interior surface 48 of the pole 24 adjacent the bore 38. The first portion 34 includes a square cross-section providing four outer flat surfaces 39*a*–*d* To ensure that the components of the assembly remain together, and to cooperate with the bore 38, the cross-sectional dimension may be in the range of about 0.750±0.010 inches. The first portion 34 may also be long enough to provide a sufficient amount of engagement with the interior 48 of the pole 24 to provide a predetermined amount of support. For example, the preferred length of engagement is about 1.528±0.010 inches.

Alternatively, the first portion 34 can have a circular cross-section with a round outer surface. For example, the cross-sectional diameter may be in the range of about 0.750±0.010 inches, and the length of engagement maybe about 1.578±0.010 inches.

The second portion 36 of the pole step stud 26 includes a first segment 40 with a square cross-section providing four outer flat surface 42*a*–*d* (note that due to the orientation of the Figures only 42*a* and 42*c* are visible) and a second segment 43 threaded to cooperate with a nut 60, as explained herein. The cross-sectional dimension may be in the range of about 0.750±0.010 inches, and the threads may be ¾-10 UNC-620. The second portion 36 also may be long enough to extend through the bore 38 to position the first portion 34 in the pole 24. For example, the first segment 40 may be 0.750±0.010, and the second segment 43 may be 0.620.

The pole step stud 26 is to be made from any material that provides sufficient strength for supporting the user and durability to withstand being in an outside environment. Appropriate materials include 430 stainless steel and may have a light zinc electroplating.

Figure 3:
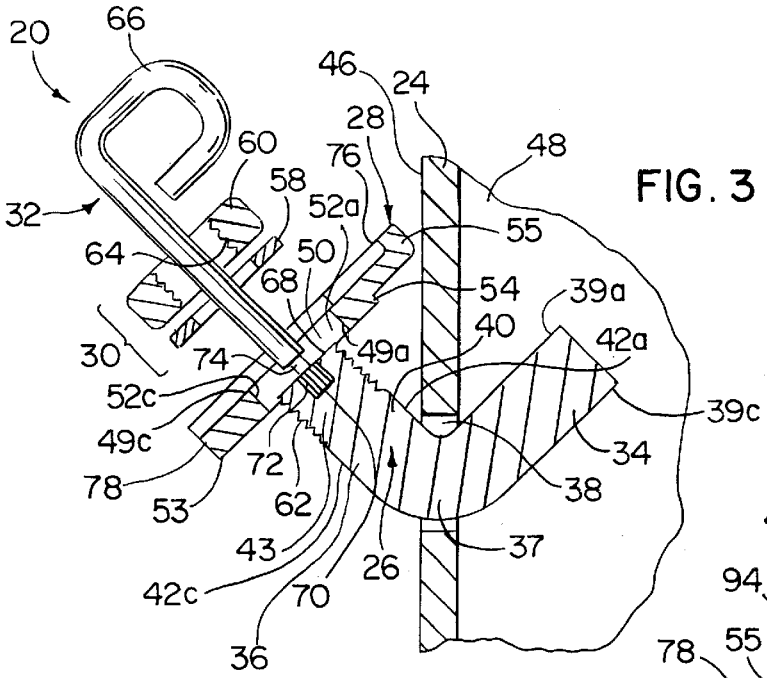
FIG. 3 is a side cross-sectional view of the mounting subassembly of the pole step assembly of FIG. 2 partially installed.
Figure 4:
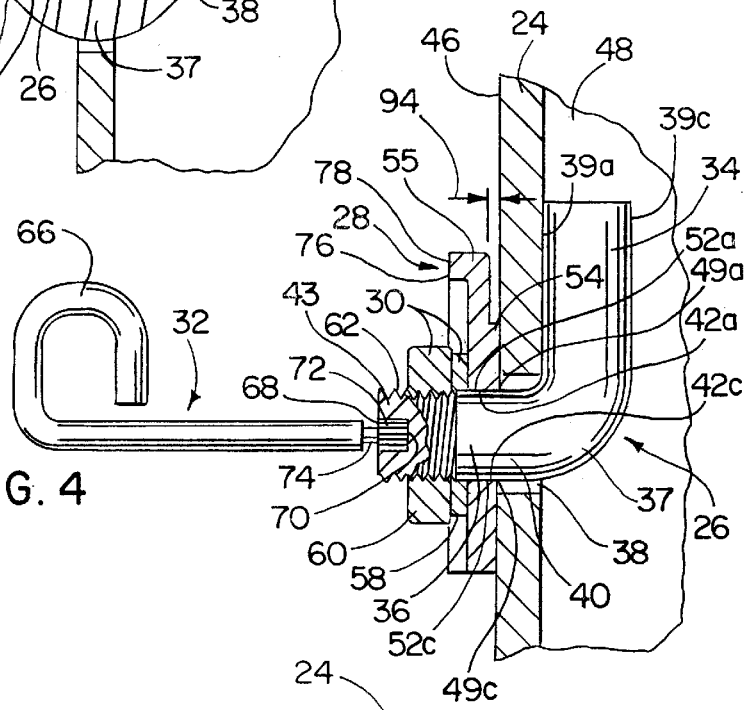
FIG. 4 is a side cross-sectional view of the mounting subassembly of FIG. 3 after being installed.

As illustrated in FIGS. 3 and 4, the mounting subassembly 20 easily attaches to the hollow pole 24. That is, the break away handle 32 is used to first rotate the first portion 34 of the pole step stud 26 through the bore 38 defined by the circumferential wall 46 of the hollow pole 24 until the first portion 34 is positioned inside the pole 24 and in engagement with the inside surface 48 of the hollow pole 24. Next, the handle 32 is turned to orient the first portion 34 to point upwards in a generally vertical direction. It is preferred that the first portion 34 be aligned generally parallel with the longitudinal axis of the pole 24.

Alternatively, the second portion can have an additional segment, thus three segments. More specifically, there may be a first segment nearest the first portion with a circular cross-section, a second segment adjacent the first with a square cross-section and a third threaded to cooperate with the nut. The first segment is designed to extend through the hole in the pole. The flat surfaces of the second segment are designed to interengage with the mounting plate to limit movement. The circular cross-section diameter may be about 0.750±0.010 inches, the square cross-section dimension may be about 0.750±0.005 inches and the threads may be ¾-10 UNC-2A. The first segment may have a length of 0.260±0.010 inches, the second segment may have a length of about 1.248±0.010 inches, and the third segment may have a length of about 0.620±0.010 inches.

Figure 6:
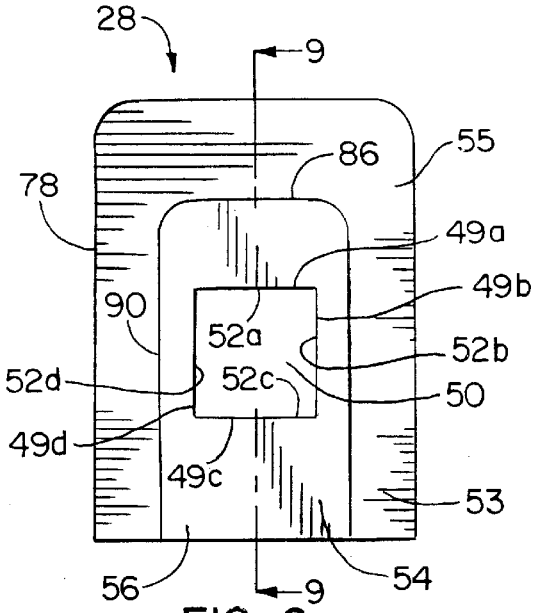
FIG. 6 is a front elevational view of the mounting plate of the mounting subassembly of the pole step assembly of FIG. 2.
Figure 7:
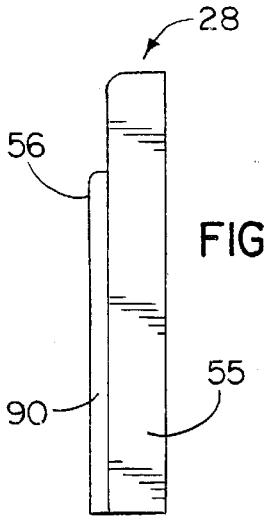
FIG. 7 is a right side elevational view of the mounting plate of FIG. 6.
Figure 8:
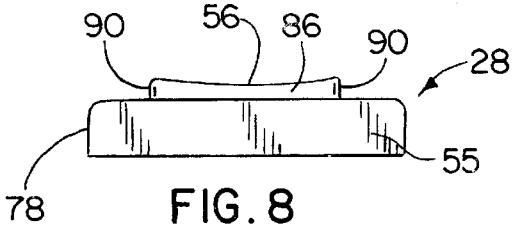
FIG. 8 is a top view of the mounting plate of FIG. 7.
Figure 9:
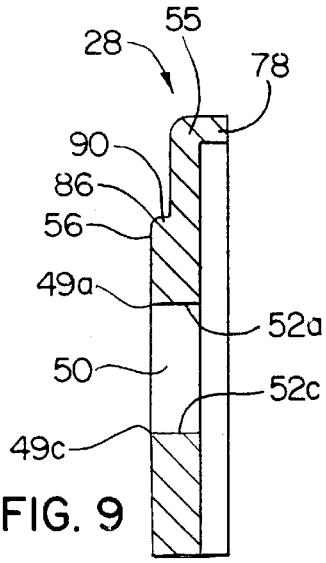
FIG. 9 is a cross-sectional view of the mounting plate of taken along line 9—9 of FIG. 6.

The mounting plate 28 is designed to engage the exterior of the hollow pole 24 and the second portion 36 of the pole step stud 26 to prevent relative movement between these components and movement relative to the pole 24. More specifically, as illustrated in FIGS. 6 and 9, the plate 28 includes four interior edges 49*a*–*d* that define a hole 50 through which the second portion 46 of the pole step stud 26 extends. The hole 50 is located generally in the center of the plate 28 and has a square cross-section that compliments the outer flat surfaces 42 of the second portion 36 of the pole step stud 26. That is, each of the edges 49 has a flat surface 52*a–d* designed to engage one of the four flat exterior surfaces 42*a*–42*d* of the second portion 36 to prevent relative rotational movement between the plate 28 and the stud 24 after installation of the mounting subassembly 20. For example, the cross-section dimension of the hole may be 0.760±0.010 inches.

The rear side 53 of the mounting plate 28 includes a center portion 54 about the hole 50 that is stepped away from the periphery portion 55 of the rear side 53. This center portion 54 spaces the periphery portion 55 of the rear side 53 from the mounting plate 28 for attachment of the removable step 22, as described infra. The center portion 54 includes an arcuate surface 56 to complement that of the exterior 46 of the pole 24 to prevent relative movement between the plate 28 and the pole 24. The arcuate surface 56 may have a radius of curvature of about 5.0 inches.

While holding the pole step stud 26 with the handle 32 to maintain the first portion 34 against the interior 48 of the pole 24, the user orients the mounting plate 28 until it is vertical and its internal flats 52 mate with the external flats 42 of the second portion 36 of the pole step stud 26. Then, the user pushes on the mounting plate 28 toward the pole 24 until the arcuate surface 56 of the mounting plate 28 engages the exterior surface 46 of the hollow pole 24. As a result, the mounting plate 28 will not rotate with respect to the pole 24 because of the engagement of the arcuate surface 56 to the pole 24 nor will the pole step stud 26 rotate with respect to the mounting plate 28 because of the engagement of the flats 52 of the interior hole 50 of the mounting plate 28 to the external flats 42 of the second portion 46 of the pole step stud 26 once the clamp 30 has been secured. Hence, the removable pole step is prevented from unintentionally rotating, due to some torque that may be provided either by a climber or some other external influence, which would result in having the first portion 34 of the pole step stud 26 no longer facing upwards, but in some other less desirable position.

The next step is for the user to tighten the clamp 30 until the mounting subassembly 20 is secured to the pole 24. The clamp 30 preferably comprises a locking washer 58 and a nut 60, so the user would first slide the locking washer 58 until it is flush with mounting plate 28 and then rotate the nut 60 until it engages the threads 62 of the second segment 43 of the second portion 36 of the pole step stud 26. Preferably, the internal threads 64 of the nut 60 and the external threads 62 of the second portion 36 of the pole step stud 26 would be of the ¾-10 UNC-2A variety to ensure that sufficient clamp force is generated. The locking washer 58 further ensures that the nut 60 will not become loose due to vibration.

After the nut 60 has been tightened, then the break away handle 32 is removed by severing its attachment to the second portion 36 of the pole step stud 26 because the purpose of the handle 32 is to prevent the mounting plate 28, locking washer 58, and nut 60 from falling off the mounting subassembly 20 before it has been secured to the pole 24, thereby facilitating installation and to provide a useful mechanism to grip, orient and otherwise manipulate the mounting subassembly 20 for installation.

The handle can be of any Shape. For example, the handle 32 can have a C-shaped curl 66 that is located at its end that is opposite to its attachment to the second portion 36 of the pole step stud 26. The handle 32 is of sufficient size and shape to prevent the other components from falling off the mounting subassembly 20. The handle 32 is removed before attaching the removable step 22 to the mounting subassembly 20 because the C-shaped curl 66 could interfere with the underside of the removable step 22.

The break away handle 32 is attached to the free end of the second portion 36 of the pole step stud 26 with a press fit friction engagement. More specifically, the free end 68 of the second portion 36 defines a centrally located hole 70 about the center axis of the second portion 36. A knurled knob 72 formed on the end of the handle 32 is press fit into the hole 70. A thin neck potion 74 is formed between the remainder of the handle 32 and the knob 72.

Preferably, the knob 72 has a diameter that is 0.009±0.010 of an inch larger than the press fit hole 70, as well as a twenty-four pitch straight knurl on its circumferential surface to make sure that there is sufficient interference to retain the knob 72 within the hole 70. For example, the diameter of the hole maybe 0.250±0.010 inches and the outer diameter of the knob 72 after knurling may be 0.259±0.010 inches.

In addition, the thin neck portion 74 should not be so long that it breaks during assembly or installation of the subassembly 20. For example, it is preferred that the thin neck 74 be about 0.093±0.010 inches in diameter and 0.125±0.010 inches long to make sure that the break away handle 32 will not be severed from the mounting subassembly 20 unintentionally but only when purposely pushed on by the user after the mounting subassembly 20 has been attached to the pole 24, causing the thin neck 74 to fracture.

The break away handle 32 may be made of any suitable material that provides sufficient durability, including metal, such as C.R.S. zinc plated.

The final step of installation would be mounting of the removable step 22 by way of the mounting subassembly 20. As shown in FIG. 4, a gap 94 forms between the periphery portion 55 of the rear side 53 about the center portion 54 of the mounting plate 28 and the exterior 46 of the pole 24. This gap 94 receives a wall portion 80 of the removable step 22, as described infra. A front side 76 of the mounting plate 28 includes a cup-like shape defined by a flange 78 extending about the top and sides of its perimeter to provide strength.

Figure 5:
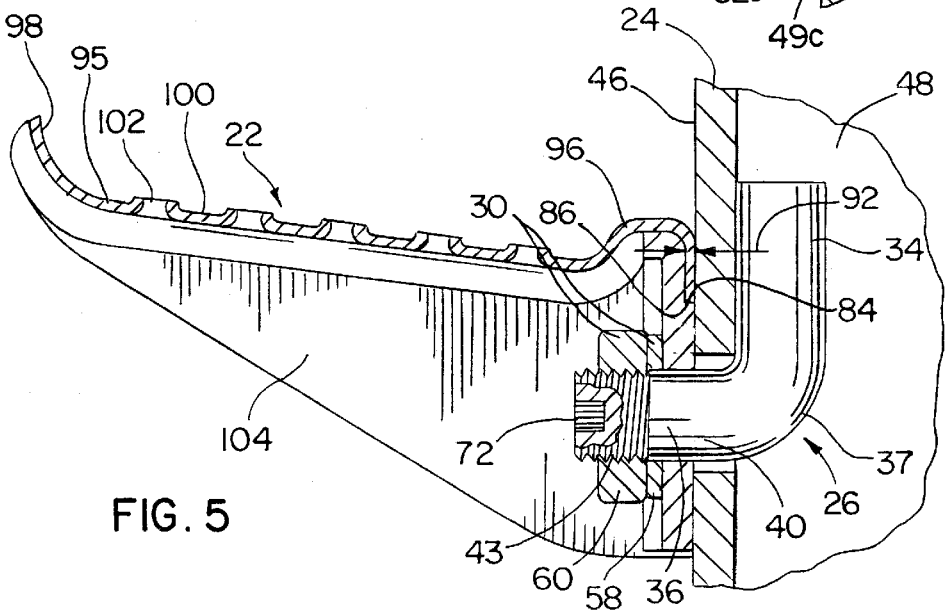
FIG. 5 is a side cross-sectional view of the removable step assembly of FIG. 1, taken along line 5—5 of FIG 1.
Figure 10:
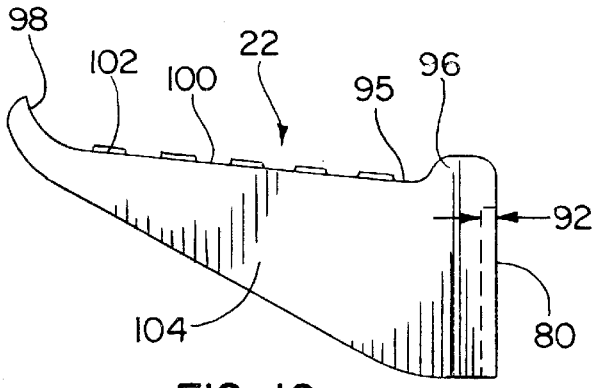
FIG. 10 is a side elevational view of the removable step of the pole step assembly of FIG. 2.
Figure 11:
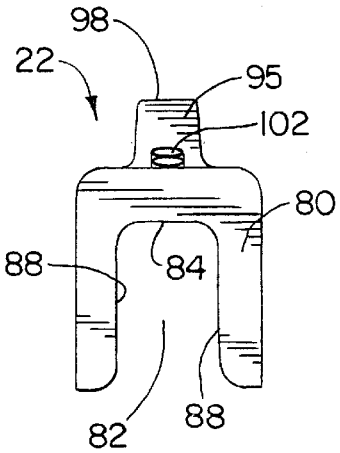
FIG. 11 is a front elevational view of the removable step of FIG. 10.

More specifically, as illustrated in FIGS. 5, 10 and 11, the front wall 80 of the removable step 22 is designed to attach the step 22 to the mounting subassembly 20. More specifically, the front wall 80 defines a slot 82 that opens downward. The slot 82 has a squared U-shape with a top straight edge 84 and a pair of generally parallel side edges 88 that form generally right angles with the top edge 90. The size of the slot 80 is designed to complement the perimeter of the center portion 54 of the mounting plate 28 of the mounting subassembly 20.

To mount the step 22, the slot 82 is slid downward over the center portion 54 until the top edge 84 of the slot 82 bottoms out on a top side 86 of the center portion 54. The side edges 88 of the slot 82 engage sides 90 of the center portion 54 to limit lateral movement of the step 22 relative to the center portion 54. Consequently, to detach the removable step 22, the step 22 is lifted upward until the wall 80 and the slot 82 are moved clear of the mounting plate 28.

The thickness 92 of the front wall 80 is coordinated to complement the width of the gap 94 between the periphery portion 55 of the rear side 53 of the mounting plate 28 about the center portion 54 and the exterior surface 46 of the hollow pole 24. This minimal clearance aids in securing the step to the mounting subassembly 20 because it is pinched between the mounting plate 28 and the pole 24.

The gap between the exterior surface 38 of the pole 24 and the periphery portion 55 of the mounting plate 28 may have a width of about 0.125±0.010 inches and the front wall 80 may have a thickness of about 0.093±0.010 inches. Thus, the preferred clearance is about 0.032±0.010 inches.

The same clearance is preferred between the side edges 88 of the slot 82 and the side 90 of the center portion 54. For example, the center portion 54 may have its sides 90 spaced apart about 1.200±0.010 inches and the side edges 88 of the slot 82 may be spaced apart about 1.265±0.010 inches. Thus, the clearance at each edge pair is about 0.032±0.010 inches.

In addition, the engagement between the straight edges 88 of the slot 82 and the straight perimeter sides 90 of the center portion 54 prevent rotational movement of the step 22 relative to the mounting plate 28 and the pole 24. Further the side edges 88 of the slot 82 may be rounded at the opening to provide guidance of the slot 82 around the center portion 54 to further aid in attaching the step 22.

The top wall 95 has a front portion with a lip 96, a stop 98 at its other end and a step portion 100 for a user's foot extending between the lip 96 and the stop 98. The lip 84 projects above the step portion 100 and defines an interior portion that receives the upper edge of the mounting plate 28. That is, the lip 96 wraps over the upper edge of the mounting plate 28 to further aid in securing the step 22 to the mounting subassembly 20.

The step portion 100 includes a tread 102 to enhance the footing of the users. The tread 102 can be in the form of raised dimples or other shapes stamped in the step portion 100. The step portion 100 tapers as it proceeds to the stop 98. The stop 98 hooks upward. and aids to prevent the user's foot from sliding off the end of the step 22.

The step 22 includes side walls 104 extending downwards from the step portion 100 of the top wall 95 and rearward from the front wall 80. The side walls 104 taper upward toward the stop 98. The side walls 104 are generally at right angles to the top wall 95 and the front wall 80 to provide support for the step portion 22.

The preferred step is approximately 5.825±0.010 inches in length to provide adequate room for a user's foot. The step may also by made from any suitable material that provides sufficient strength to support a user. For example, the material can be 0.93 inch thick cold roll galvanized steel.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is not intended that. the invention be limited to the particular embodiments illustrated by the drawings and described in the specification as the best modes presently contemplated for carrying out this invention, but that the invention will include any embodiments falling within the description of the appended claims.

What is claimed is:

1. A step assembly that is capable of selectively securing a removable step to a hollow pole, the hollow pole being adapted to define at least one mounting aperture, the assembly comprising:

a mounting stud having a first portion and a second portion, the first portion being capable of engaging the hollow pole to support the mounting stud, the second portion having an exterior flat portion and being capable of extending through an aperture in the hollow pole to position the first portion inside the hollow pole;

a mounting plate on the stud having an interior surface with a flat portion to engage the exterior flat portion of the second portion of the mounting stud to limit relative movement between the mounting plate and the mounting stud, a major exterior surface and a minor exterior surface, the major exterior surface being stepped from the minor exterior surface such that the major exterior surface is capable of engaging the hollow pole and a gap forms between the minor exterior surface and the hollow pole when the major surface engages the hollow pole, the major exterior surface having at least a portion profiled so when it is engaged with the hollow pole it limits movement between the hollow pole and the mounting plate;

a clamp on the mounting stud and being capable of selectively engaging the second portion of the mounting stud to secure the mounting plate and the first portion of the stud into engagement with the hollow pole to limit relative movement of the mounting plate and mounting stud with respect to the hollow pole; and a removable step having a mounting portion and a foot support portion, the mounting portion defining a slot, the mounting portion being capable of a being received in the gap to engage at least a portion of the minor exterior surface surround at least a portion of the major surface to limit movement of the step relative to the hollow pole when the mounting plate is in engagement with the pole.

2. The pole step assembly of claim 1 wherein the mounting stud further includes a handle to facilitate installation of the mounting stud and mounting plate.

3. The pole step assembly of claim 2 wherein the handle is removably attached to the mounting stud.

4. The pole step assembly of claim 3 wherein the handle has an enlarged end portion to maintain the mounting plate and clamp on the mounting stud.

5. The pole step assembly of claim 4 wherein the second portion of the mounting stud defines a recess and wherein the handle has a mounting end that is press fit into the recess to attach the handle.

6. The pole step assembly of claim 5 wherein the handle has a weaker portion that is capable of being severed to remove the handle when desired.

7. The pole step assembly of claim 6 wherein the enlarged end portion of the handle has C-shape.

8. The pole step assembly of claim 1 wherein the first portion and the second portion of the mounting stud are disposed at a predetermined angle relative to one another.

9. The pole step assembly of claim 8 wherein the predetermined angle between the first portion and second portion of the mounting stud is generally 90 degrees so that the second portion is capable of extending in a direction that is generally parallel to the radius of the hollow pole.

10. The removable step assembly of claim 8 wherein the major exterior surface of the mounting plate has an arcuate profiled portion so when it the mounting stud is engaged with the hollow pole movement is limited between the hollow pole and the mounting plate.

11. The pole step assembly of claim 8 wherein the second portion of the mounting stud has an externally threaded portion.

12. The pole step assembly of claim 11 wherein the clamp further comprises a nut that meshes with the externally threaded portion of the second portion of the mounting stud.

13. The pole step assembly of claim 12 wherein the clamp further comprises a lock washer interposed between the nut and the mounting plate.

14. The pole step assembly of claim 8 wherein the first portion of the mounting stud is sized large enough to prevent the mounting plate and clamp from falling off the mounting stud at the first portion.

15. The pole step assembly of claim 8 wherein the exterior flat portion of the second portion of the mounting stud includes at least two flats and the flat portion of the interior surface of the mounting plate includes at least two flats, the flats of the second portion and of the interior surface being capable of engaging each other to limit relative movement between the mounting plate and the mounting stud.

16. The method of attaching a removable pole step assembly to a hollow pole comprising:

providing a removable pole step assembly having a mounting subassembly with a removable handle;

attaching the mounting subassembly to a hollow pole;

detaching the removable handle once the mounting subassembly has been attached to the hollow pole; and attaching a removable step to the mounting subassembly.

* * * * *

UNITED STATES PATENT AND TRADEMARK OFFICE

CERTIFICATE OF CORRECTION

PATENT NO. : 6,491,272 B1
DATED : December 10, 2002
INVENTOR(S) : George J. Franks It is certified that error appears in the above-identified patent and that said Letters Patent is hereby corrected as shown below:

Column 8,
Line 13, after "major" insert -- exterior --.
Line 18, delete "and being".
Line 28, after "surface" insert -- and --.
Line 29, before "surface" insert -- exterior --.

Signed and Sealed this

Twenty-second Day of April, 2003

JAMES E. ROGAN
*Director of the United States Patent and Trademark Office*